US009799960B2

(12) United States Patent
Suzuki

(10) Patent No.: US 9,799,960 B2
(45) Date of Patent: Oct. 24, 2017

(54) METAL PLATE LENS COMPRISING MULTIPLE METALLIC PLATES WITH THROUGH HOLES OF DIFFERENT SIZES

(71) Applicant: IBARAKI UNIVERSITY, Mito-shi, Ibaraki (JP)

(72) Inventor: Takehito Suzuki, Hitachi (JP)

(73) Assignee: IBARAKI UNIVERSITY, Mito (JP)

( * ) Notice: Subject to any disclaimer, the term of this patent is extended or adjusted under 35 U.S.C. 154(b) by 151 days.

(21) Appl. No.: 14/776,004

(22) PCT Filed: Mar. 14, 2014

(86) PCT No.: PCT/JP2014/056836

§ 371 (c)(1),
(2) Date: Sep. 14, 2015

(87) PCT Pub. No.: WO2014/142294

PCT Pub. Date: Sep. 18, 2014

(65) Prior Publication Data

US 2016/0028142 A1 Jan. 28, 2016

(30) Foreign Application Priority Data

Mar. 15, 2013 (JP) ..... 2013-053575

(51) Int. Cl.
*H01Q 15/10* (2006.01)
*H01Q 15/04* (2006.01)
*H01P 3/20* (2006.01)

(52) U.S. Cl.
CPC ..... *H01Q 15/10* (2013.01); *H01P 3/20* (2013.01); *H01Q 15/04* (2013.01)

(58) Field of Classification Search
CPC ..... H01Q 15/02; H01Q 15/04; H01Q 15/06; H01Q 15/10

(Continued)

(56) References Cited

U.S. PATENT DOCUMENTS 4,841,989 A 6/1989 Kikuchi et al.
2011/0317275 A1 12/2011 Smith et al.
2012/0326800 A1* 12/2012 Liu et al. ..... H01Q 15/006 333/32

FOREIGN PATENT DOCUMENTS

JP S62-2953 A 1/1987
JP S62-2954 A 1/1987

(Continued)

OTHER PUBLICATIONS

U.S. Appl. No. 60/590,702, filed Jul. 23, 2004.
Jun. 17, 2014 International Search Report issued in International Patent Application No. PCT/JP2014/056836.

*Primary Examiner* — Benny Lee
(74) *Attorney, Agent, or Firm* — Oliff PLC

(57) ABSTRACT

Optical axis as central axis is defined as z-axis, and axes perpendicular to z-axis are defined as x- and y-axis. Metallic flat plates are formed parallel to x-z plane to overlap each other and be separated by a given distance. Multiple flat plates except the top flat plate and bottom flat plate are each provided with multiple through holes. Central flat plates are each provided with through holes of a first radius. Intermediate flat plates arranged between central flat plate and top flat plate and between central flat plate and bottom flat plate are each provided with through holes of a second radius smaller than first radius. Second radius of through holes formed in an intermediate flat plate arranged in a position farther from central flat plate is smaller than second size of through holes formed in an intermediate flat plate arranged in a position closer to central flat plate.

12 Claims, 12 Drawing Sheets

(58) Field of Classification Search
USPC ..... 343/753
See application file for complete search history.

(56) References Cited

FOREIGN PATENT DOCUMENTS

| | | | |
|---|---|---|---|
| JP | 2006-074551 | A | 3/2006 |
| JP | 2010-213021 | A | 9/2010 |
| JP | 2011-254482 | A | 12/2011 |

* cited by examiner

Dimension parameter (Design frequency: 0.5THz)

| | | | |
|---|---|---|---|
| $l$ | 2.1 mm (3.5 $\lambda$) | $d$ | 0.310 mm (0.52 $\lambda$) |
| $w$ | 4.2 mm (7.0 $\lambda$) | $t$ | 0.030 mm (0.050 $\lambda$) |
| $h$ | 3.77 mm (6.3 $\lambda$) | | |
| 12Plates | | | |

| | |
|---|---|
| $d$ | 0.310 mm (0.52λ) |
| $h$ | 3.77 mm (6.3 λ) |
| 12 Plates | |

(a) Parameter of the reference model

| | |
|---|---|
| $r_1$ | 5.0 μm (0.0083λ) |
| $r_2$ | 40 μm (0.067λ) |
| $r_3$ | 65 μm (0.11λ) |
| $r_4$ | 80 μm (0.13λ) |
| $r_5$ | 85 μm (0.14λ) |

(b) Radius of each hole of the reference model

Analysis results of the reference model

Distribution of the magnitude of an electric field on the optical axis (a) Distribution of the magnitude of an electric field in this focal point in the x direction (b) Distribution of the magnitude of an electric field in this focal point in the y direction

| | |
|---|---|
| $d$ | 0.310 mm (0.52λ) |
| $h$ | 3.77 mm (6.3 λ) |
| 12 Plates | |

(a) Parameter of the first model

| | |
|---|---|
| $r_1$ | 15 μm (0.025λ) |
| $r_2$ | 50 μm (0.083λ) |
| $r_3$ | 70 μm (0.12λ) |
| $r_4$ | 80 μm (0.13λ) |
| $r_5$ | 85 μm (0.14λ) |

(b) Radius of each hole of the first model

Analysis results of the first model (a) Distribution of the magnitude of an electric field on the optical axis (b) Distribution of the magnitude of an electric field in this focal point in the x direction (c) Distribution of the magnitude of an electric field in this focal point in the y direction

| | |
|---|---|
| $d$ | 0.310 mm (0.52λ) |
| $h$ | 3.09 mm (5.15λ) |
| 10 Plates | |

(a) Parameter of the second model

| | |
|---|---|
| $r_1$ | 25 μm (0.042λ) |
| $r_2$ | 55 μm (0.092λ) |
| $r_3$ | 75 μm (0.13λ) |
| $r_4$ | 85 μm (0.14λ) |

(b) Radius of each hole of the second model

Analysis results of the second model (a) Distribution of the magnitude of an electric field on the optical axis (b) Distribution of the magnitude of an electric field in this focal point in the x direction (c) Distribution of the magnitude of an electric field in this focal point in the y direction

| | |
|---|---|
| $d$ | 0.350 mm (0.58λ) |
| $h$ | 4.21 mm (7.02λ) |
| 12 Plates | |
Parameter of the third mode
Fig. 15
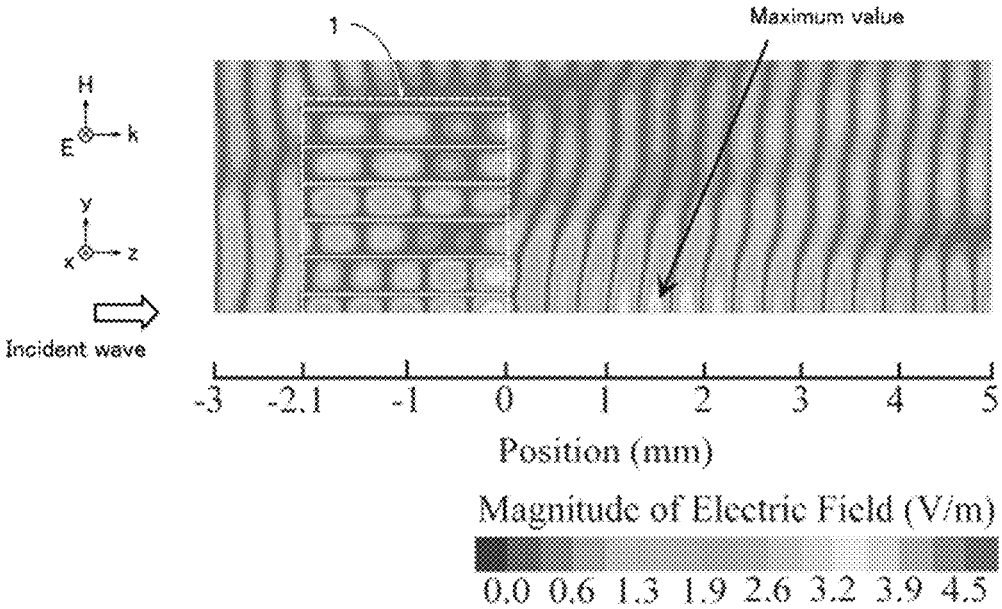
Analysis results of the third model
Fig. 16
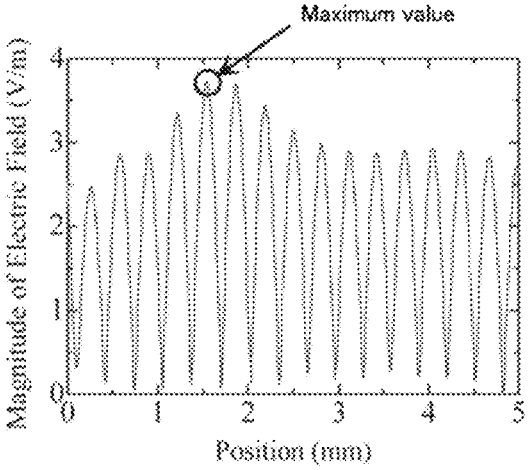
Distribution of the magnitude of an electric field on the optical axis
Fig. 17

| | | | |
|---|---|---|---|
| $d_1$ | 0.36 mm (0.60λ) | $d_5$ | 0.32 mm (0.53λ) |
| $d_2$ | 0.35 mm (0.58λ) | $d_6$ | 0.31 mm (0.52λ) |
| $d_3$ | 0.34 mm (0.57λ) | $h$ | 4.02 mm (6.7λ) |
| $d_4$ | 0.33 mm (0.55λ) | 12 Plates | |
Parameter of the fourth mode
Fig. 18
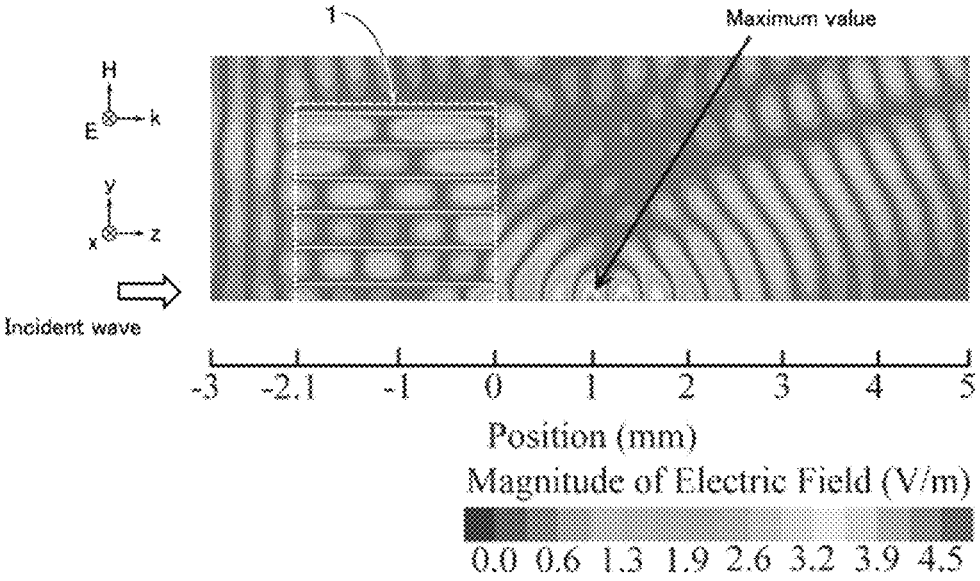
Analysis results of the fourth model
Fig. 19
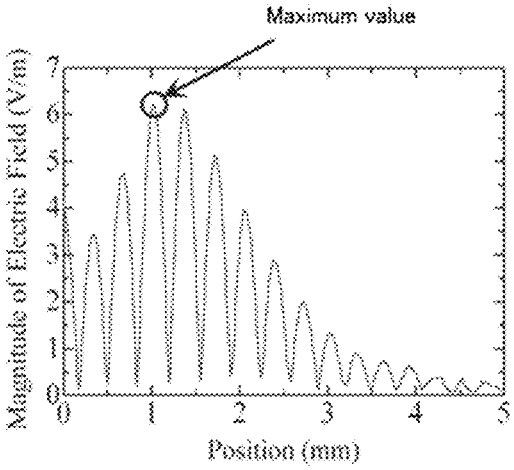
Distribution of the magnitude of an electric field on the optical axis
Fig. 20

(a)

(b)

METAL PLATE LENS COMPRISING MULTIPLE METALLIC PLATES WITH THROUGH HOLES OF DIFFERENT SIZES

TECHNICAL FIELD

This invention relates to a metal plate lens that allows focusing of an electromagnetic wave such as a terahertz wave.

BACKGROUND ART

A terahertz electromagnetic wave is an electromagnetic wave having a frequency from 0.1 to 10 THz (wavelength from 30 μm to 3000 μm). This wavelength is substantially the same as a range from the wavelength of a far-infrared wave to that of a millimeter wave. The terahertz electromagnetic wave exists in a frequency range between the frequency of "light" and that of a "millimeter wave." Thus, the terahertz electromagnetic wave has both an ability to identify an object with a spatial resolution as high as that of light and an ability comparable to that of a millimeter wave to pass through a substance. An electromagnetic wave in the terahertz wave band has not been explored so far. Meanwhile, for example, application of characterization of a material has been examined for time-domain spectroscopy, imaging, and tomography utilizing the characteristics of the electromagnetic wave in this frequency band. The terahertz electromagnetic wave has both the performance of passing through a substance and straightness. Thus, using the terahertz electromagnetic wave instead of an X-ray allows safe and innovative imaging or ultrahigh-speed wireless communication of some hundreds of Gbps.

Veselago showed that incidence of light on a medium having a permittivity and a magnetic permeability both of negative values causes negative refraction and an artificial structure producing a negative permittivity and a negative magnetic permeability has been suggested. Such an artificial structure producing a negative permittivity and a negative magnetic permeability is an artificial structure called a metamaterial having a scale sufficiently larger than atoms and smaller than a light wavelength. Using the metamaterial to cause negative refraction allows formation of a perfect lens having a planar shape. A conventional lens encounters diffraction limitation that makes it impossible to observe an object smaller than the light wavelength. The perfect lens overcomes the diffraction limitation to allow observation of a tiny object.

In one example of a known metamaterial, the metamaterial includes a split ring resonator exhibiting a negative magnetic permeability formed of two rings of two different sizes having respective cuts formed in opposite positions and a matrix of unit cells formed of metallic wires exhibiting a negative permittivity (see patent literature 1). This metamaterial becomes applicable to a lens, for example, by arranging these unit cells along one axis so as to form a gradient refractive index to achieve a negative refractive index.

PRIOR ART LITERATURE

Patent Literature

Patent Literature 1: Japanese Patent Application Publication No. 2011-254482

SUMMARY OF THE INVENTION

The Problem to be Solved by the Invention

However, if the unit cells capable of achieving a negative refractive index described in patent literature 1 are to be applied to a range of a short wavelength such as that of a terahertz wave, the dimension of the unit cells should be a tiny size of the order of micrometers that is about one-sixth or less than one-sixth of the wavelength of the terahertz wave in free space. This makes it quite difficult to form the unit cells.

The object of this invention is to provide a metal plate lens having a structure that can be formed easily to be responsive to even a range of a short wavelength such as that of a terahertz wave without employing a structure to achieve a negative refractive index.

Means for Solving the Problem

To achieve the aforementioned object, a metal plate lens of this invention includes metallic flat plates. The metal plate lens has an optical axis as a central axis defined as a z-axis, and axes perpendicular to the z-axis defined as an x-axis and a y-axis. The metallic flat plates are formed on corresponding multiple planes so as to overlap each other. The multiple planes are parallel to an x-z plane and separated by a given distance along the y-axis. Two or more of the multiple flat plates arranged so as to overlap each other except a top flat plate arranged at the top and a bottom flat plate arranged at the bottom are each provided with multiple through holes of a given size. A central flat plate of the flat plates arranged in a central part is provided with the through holes of a first size. An intermediate flat plate arranged between the central flat plate and the top flat plate and an intermediate flat plate arranged between the central flat plate and the bottom flat plate are each provided with the through holes of a second size smaller than the first size. If the intermediate flat plate arranged between the central flat plate and the top flat plate includes multiple intermediate flat plates and the intermediate flat plate arranged between the central flat plate and the bottom flat plate includes multiple intermediate flat plates, the second size of the through holes formed in one of the multiple intermediate flat plates arranged in a position farther from the central flat plate is smaller than the second size of the through holes formed in one of the multiple intermediate flat plates arranged in a position closer to the central flat plate.

Advantageous Effect of the Invention

The metal plate lens of this invention includes the metallic flat plates arranged so as to overlap each other. The central flat plate and the intermediate flat plate are each provided with the through holes of the respective sizes. The size of the through holes is larger in the central flat plate than in the intermediate flat plate. The wavelength of an electromagnetic wave to propagate between the metallic flat plates is longer than that of an electromagnetic wave to propagate in free space. This makes the wavelength of an electromagnetic wave to propagate between flat plates with through holes shorter than that of an electromagnetic wave to propagate between flat plates without through holes. A wavelength is reduced further in response to a larger size of through holes. Thus, the wavelength of an electromagnetic wave to propagate using the central flat plate becomes shorter than that of an electromagnetic wave to propagate using the intermediate flat plate. The wavelength of an electromagnetic wave to propagate using the intermediate flat plate becomes shorter than that of an electromagnetic wave to propagate using the top flat plate and the bottom flat plate without through holes. Arranging the metallic flat plates with the aforementioned through holes in an overlapping relationship makes the metallic flat plates act as a lens. Thus, the metal plate lens of this invention can be formed easily without employing a structure to achieve a negative refractive index even if the metal plate lens is to be applied to a range of a short wavelength such as that of a terahertz wave.

BRIEF DESCRIPTION OF THE DRAWINGS

FIG. 15 is a table showing an example of the dimension of a parameter regarding a metal plate lens including 12 metal plates of this invention following a third model.

FIG. 16 shows a result of analysis on the metal plate lens of this invention following the third model.

FIG. 17 shows a distribution of the magnitude of an electric field in (V/m) on the optical axis of the metal plate lens of this invention following the third model.

FIG. 18 is a table showing an example of the dimension of a parameter regarding a metal plate lens including 12 metal plates of this invention following a fourth model.

FIG. 19 shows a result of analysis on the metal plate lens of this invention following the fourth model.

FIG. 20 shows a distribution of the magnitude of an electric field in (V/m) on the optical axis of the metal plate lens of this invention following the fourth model.

EMBODIMENTS FOR CARRYING OUT THE INVENTION

The following detailed description refers to the accompanying drawings. The same reference numbers in different drawings may identify the same or similar elements.

Figures 1, 2:
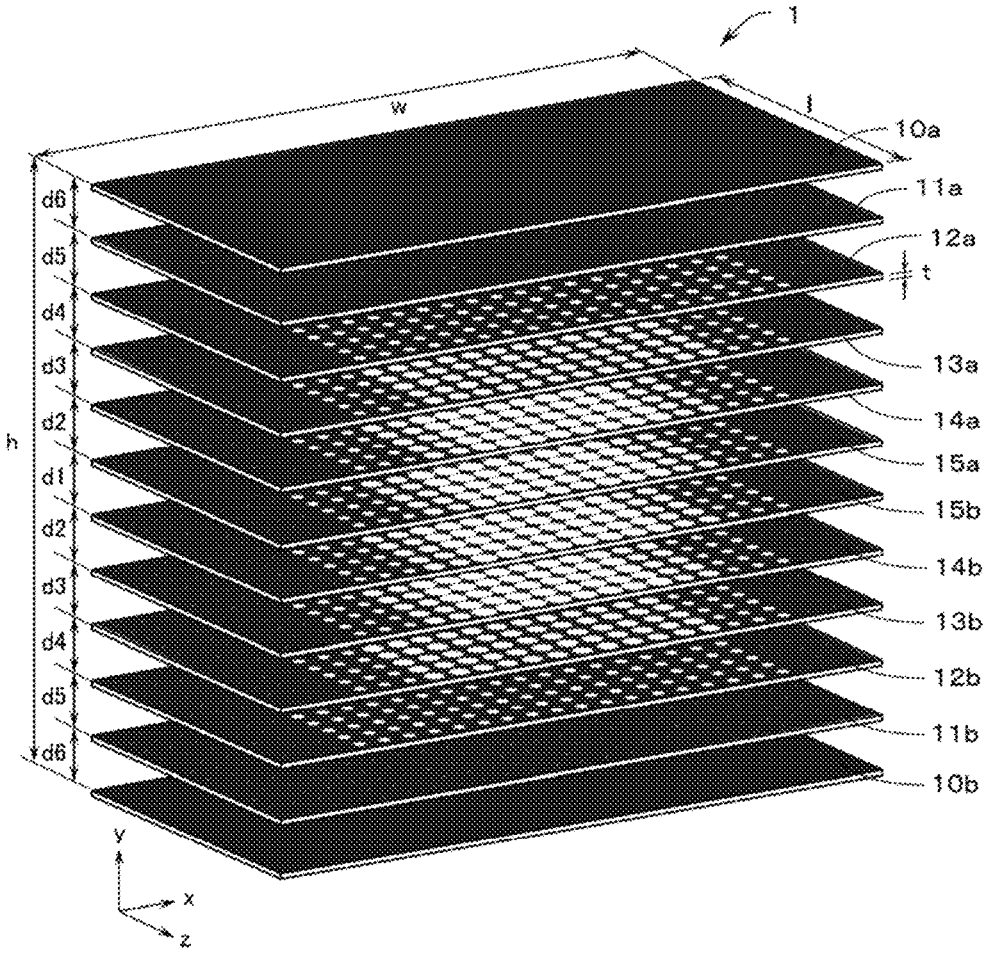
FIG. 1 is a perspective view showing the structure of a metal plate lens of an embodiment of this invention.
FIG. 2 is a table showing an example of the dimension of the metal plate lens including 12 metal plates of the embodiment of this invention.

FIG. 1 is a perspective view showing the structure of a metal plate lens of an embodiment of this invention. A metal plate lens 1 of the embodiment of this invention shown in FIG. 1 has an optical axis as a central axis defined as a z-axis, and axes perpendicular to the z-axis defined as an x-axis and a y-axis. The metal plate lens 1 includes twelve (12) metallic flat plates 10*a*, 10*b*, 11*a*, 11*b*, 12*a*, 12*b*, 13*a*, 13*b*, 14*a*, 14*b*, 15*a*, and 15*b* formed on corresponding multiple planes parallel to the x-z plane so as to extend parallel in an overlapping relationship and to be separated by a given distance. The top flat plate 10*a* arranged at the top and the bottom flat plate 10*b* arranged at the bottom are not provided with through holes. Meanwhile, the two central flat plates 15*a* and 15*b* arranged in a central part, the four intermediate flat plates 11*a*, 12*a*, 13*a*, and 14*a* arranged between the top flat plate 10*a* and the central flat plate 15*a*, and the four intermediate flat plates 11*b*, 12*b*, 13*b*, and 14*b* arranged between the bottom flat plate 10*b* and the central flat plate 15*b* are all provided with through holes of respective given radii.

The metal plate lens 1 of this invention has a width w, a length l (lower-case l) in the direction of the optical axis (z-axis), and a height h. The central flat plates 15*a* and 15*b* are arranged in the center of the metal plate lens 1 so as to be separated by a distance d1. The fourth intermediate flat plates 14*a* and 14*b* are arranged lateral to the central flat plates 15*a* and 15*b* so as to be separated by a distance d2 from the central flat plates 15*a* and 15*b* respectively. The third intermediate flat plates 13*a* and 13*b* are arranged lateral to the fourth intermediate flat plates 14*a* and 14*b* so as to be separated by a distance d3 from the fourth intermediate flat plates 14*a* and 14*b* respectively. The second intermediate flat plates 12*a* and 12*b* are arranged lateral to the third intermediate flat plates 13*a* and 13*b* so as to be separated by a distance d4 from the third intermediate flat plates 13*a* and 13*b* respectively. The first intermediate flat plates 11*a* and 11*b* are arranged lateral to the second intermediate flat plates 12*a* and 12*b* so as to be separated by a distance d5 from the second intermediate flat plates 12*a* and 12*b* respectively. The top flat plate 10*a* and the bottom flat plate 10*b* are arranged lateral to the first intermediate flat plates 11*a* and 11*b* so as to be separated by a distance d6 from the first intermediate flat plates 11*a* and 11*b* respectively. All the flat plates 10*a*, 10*b*, 11*a*, 11*b*, 12*a*, 12*b*, 13*a*, 13*b*, 14*a*, 14*b*, 15*a*, and 15*b* have a uniform thickness t.

FIG. 2 shows an example of the dimension of the metal plate lens 1 of this invention determined on condition that the design frequency of the metal plate lens 1 is 0.5 THz. The wavelength of the design frequency is expressed as λ.

As shown in FIG. 2, regarding the metal plate lens 1 of this invention, each of the 12 flat plates 10*a*, 10*b*, 11*a*, 11*b*, 12*a*, 12*b*, 13*a*, 13*b*, 14*a*, 14*b*, 15*a*, and 15*b* has the length 1 of about 2.1 mm (about 3.5λ) in the direction of the optical axis (z-axis), each of the flat plates 10*a*, 10*b*, 11*a*, 11*b*, 12*a*, 12*b*, 13*a*, 13*b*, 14*a*, 14*b*, 15*a*, and 15*b* has the width w of about 4.2 mm (about 7.0λ) in the x-axis direction, the height h of the metal plate lens 1 in the y-axis direction is about 3.77 mm (about 6.3λ), the distances d1 to d6 between corresponding ones of the flat plates 10*a*, 10*b*, 11*a*, 11*b*, 12*a*, 12*b*, 13*a*, 13*b*, 14*a*, 14*b*, 15*a*, and 15*b* are uniformly d of about 0.310 mm (about 0.52λ), and all the flat plates 10*a*, 10*b*, 11*a*, 11*b*, 12*a*, 12*b*, 13*a*, 13*b*, 14*a*, 14*b*, 15*a*, and 15*b* have the thickness t of about 0.030 mm (about 0.050λ).

Figure 3:
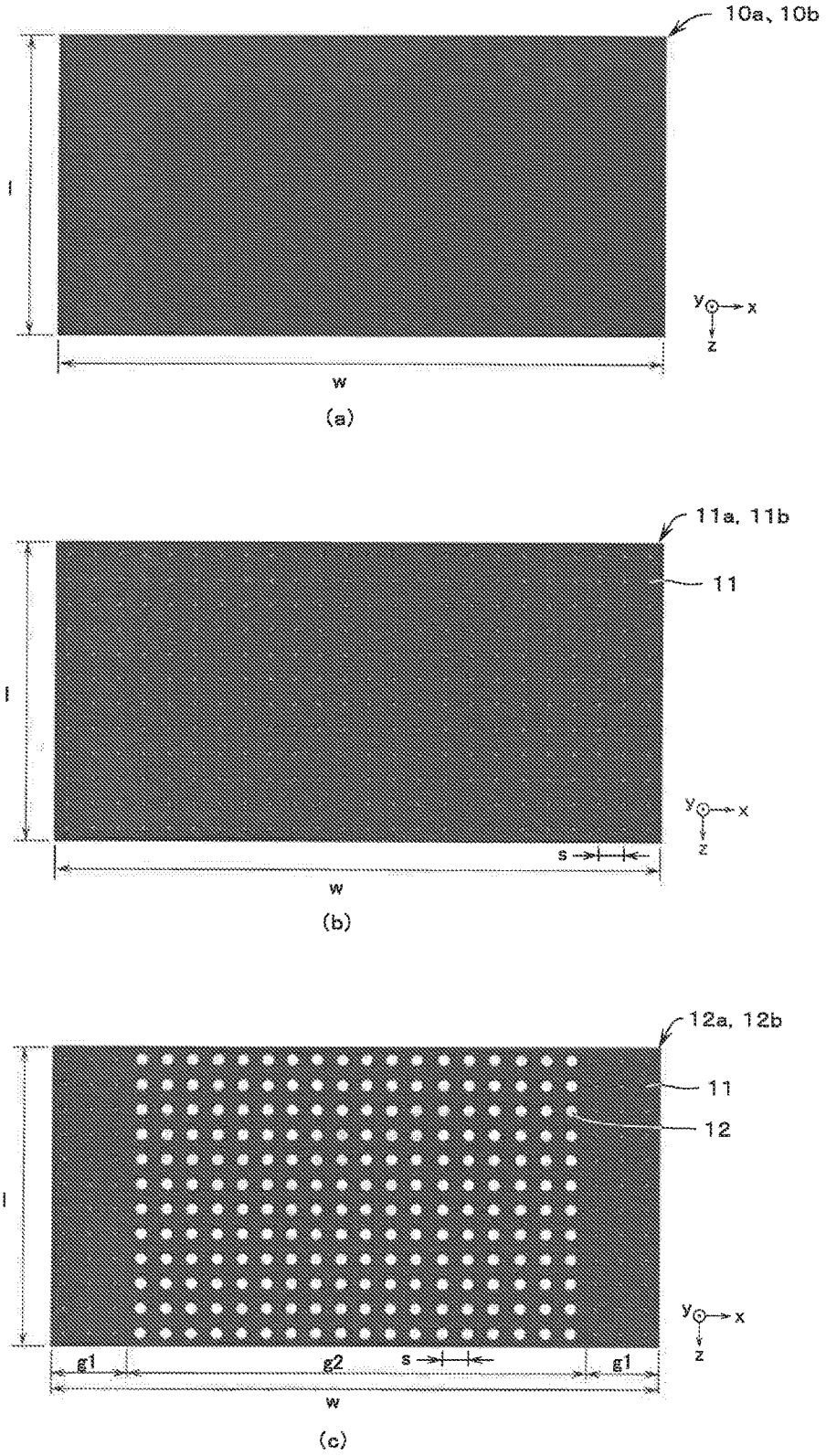
FIG. 3 is a plan view showing the structure of a flat plate forming the metal plate lens of the embodiment of this invention.
Figure 4:
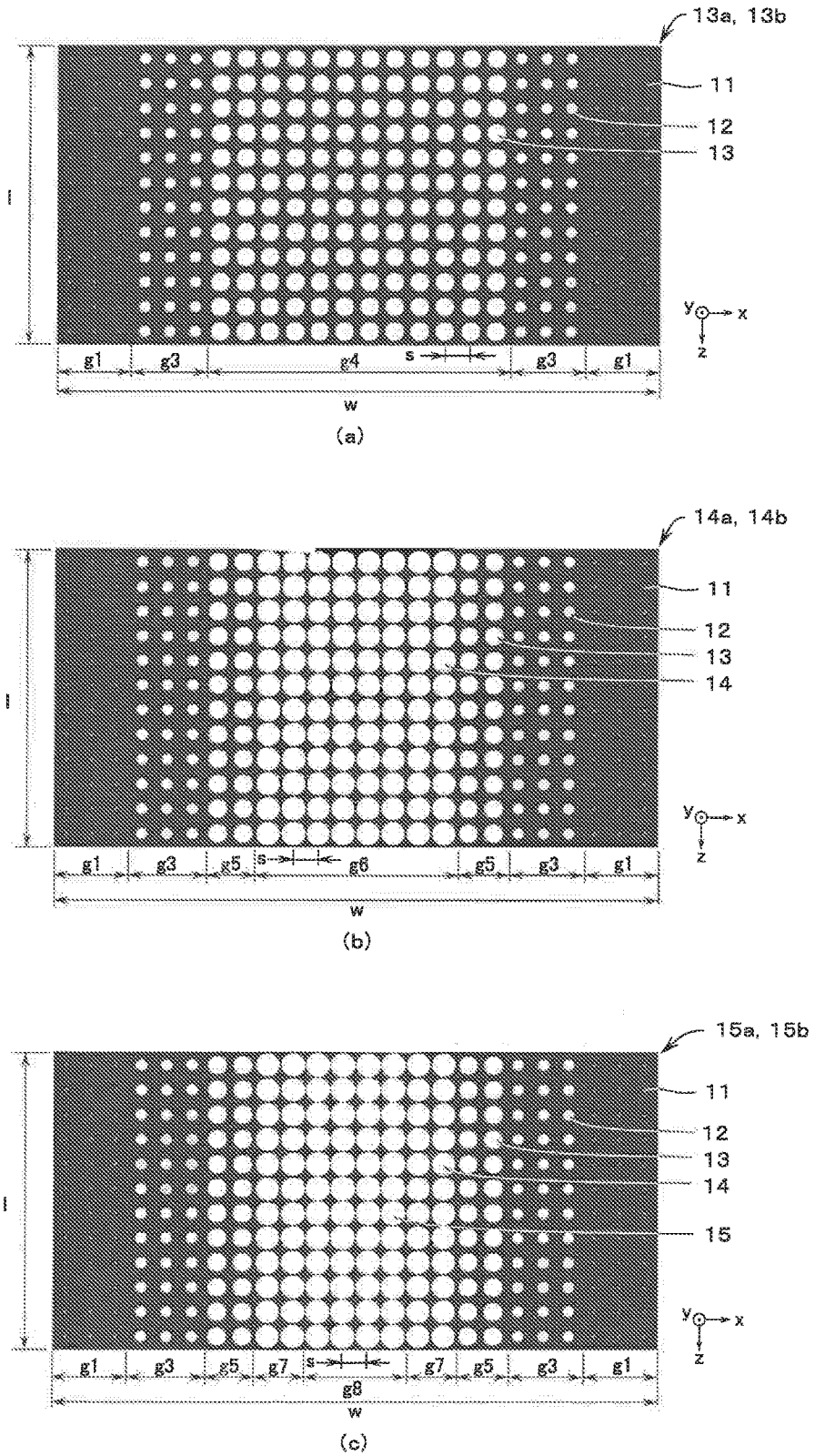
FIG. 4 is a plan view showing the structure of a different flat plate forming the metal plate lens of the embodiment of this invention.

The structure of each flat plate forming the metal plate lens of this invention is shown in FIGS. 3 and 4. FIG. 3(*a*) is a plan view showing the structure of each of the top flat plate 10*a* and the bottom flat plate 10*b*. FIG. 3(*b*) is a plan view showing the structure of each of the first intermediate flat plates 11*a* and 11*b*. FIG. 3(*c*) is a plan view showing the structure of each of the second intermediate flat plates 12*a* and 12*b*. FIG. 4(*a*) is a plan view showing the structure of each of the third intermediate flat plates 13*a* and 13*b*. FIG. 4(*b*) is a plan view showing the structure of each of the fourth intermediate flat plates 14*a* and 14*b*. FIG. 4(*c*) is a plan view showing the structure of each of the central flat plates 15*a* and 15*b*.

As shown FIG. 3(*a*), the top flat plate 10*a* and the bottom flat plate 10*b* are each formed of a metallic flat plate of a horizontally-long rectangular shape with no through holes.

The first intermediate flat plates 11*a* and 11*b* are arranged adjacent to the respective inner sides of the top flat plate 10*a* and the bottom flat plate 10*b* respectively. As shown in FIG. 3(*b*), the first intermediate flat plates 11*a* and 11*b* are formed of metallic flat plates of the same horizontally-long rectangular shape. These metallic flat plates each have through holes 11 of a given radius r1 formed entirely in the flat plates and separated by a given distance. The through holes 11 are formed in a matrix and separated by a distance s, as shown in FIG. 3(*c*).

The second intermediate flat plates 12*a* and 12*b* are arranged adjacent to the respective inner sides of the first intermediate flat plates 11*a* and 11*b* respectively. As shown in FIG. 3(*c*), the second intermediate flat plates 12*a* and 12*b* are formed of metallic flat plates of the same horizontally-long rectangular shape. These metallic flat plates each have the through holes 11 of the radius r1 separated by a given distance and arranged in three columns in opposite lateral regions g1 and through holes 12 of a radius r2 larger than the radius r1 separated by a given distance and arranged in a matrix in a central region g2 between the two regions g1 where the through holes 11 are formed. The through holes 11 and the through holes 12 are both separated by the distance s.

The third intermediate flat plates 13*a* and 13*b* are arranged adjacent to the respective inner sides of the second intermediate flat plates 12*a* and 12*b* respectively. As shown in FIG. 4(*a*), the third intermediate flat plates 13*a* and 13*b* are formed of metallic flat plates of the same horizontally-long rectangular shape. These metallic flat plates each have the through holes 11 of the radius r1 separated by a given distance and arranged in three columns in the opposite lateral regions g1 and the through holes 12 of the radius r2 larger than the radius r1 separated by a given distance and arranged in three columns in two regions g3 located adjacent to the regions g1 where the through holes 11 are formed so as to approach more closely toward the center. These metallic flat plates each further have through holes 13 of a radius r3 larger than the radius r2 separated by a given distance and arranged in a matrix in a central region g4 between the two regions g3 where the through holes 12 are formed. The through holes 11, the through holes 12, and the through holes 13 are all separated by the distance s, as shown in FIGS. 4(*a*), 4(*b*), and 4(*c*).

The fourth intermediate flat plates 14*a* and 14*b* are arranged adjacent to the respective inner sides of the third intermediate flat plates 13*a* and 13*b* respectively. As shown in FIG. 4(*b*), the fourth intermediate flat plates 14*a* and 14*b* are formed of metallic flat plates of the same horizontally-long rectangular shape. These metallic flat plates each have the through holes 11 of the radius r1 separated by a given distance and arranged in three columns in the opposite lateral regions g1 and the through holes 12 of the radius r2 larger than the radius r1 separated by a given distance and arranged in three columns in the two regions g3 located adjacent to the regions g1 where the through holes 11 are formed so as to approach more closely toward the center. These metallic flat plates each further have the through holes 13 of the radius r3 larger than the radius r2 separated by a given distance and arranged in two columns in two regions g5 located adjacent to the regions g3 where the through holes 12 are formed so as to approach more closely toward the center and through holes 14 of a radius r4 larger than the radius r3 separated by a given distance and arranged in eight columns in a central region g6 between the two regions g5 where the through holes 13 are formed. The through holes 11, the through holes 12, the through holes 13, and the through holes 14 are all separated by the distance s.

The two central flat plates 15*a* and 15*b* are arranged between the fourth intermediate flat plates 14*a* and 14*b*. As shown in FIG. 4(*c*), the central flat plates 15*a* and 15*b* are formed of metallic flat plates of the same horizontally-long rectangular shape. These metallic flat plates each have the through holes 11 of the radius r1 separated by a given distance and arranged in three columns in the opposite lateral regions g1 and the through holes 12 of the radius r2 larger than the radius r1 separated by a given distance and arranged in three columns in the two regions g3 located adjacent to the regions g1 where the through holes 11 are formed so as to approach more closely toward the center. These metallic flat plates each further have the through holes 13 of the radius r3 larger than the radius r2 separated by a given distance and arranged in two columns in the two regions g5 located adjacent to the regions g3 where the through holes 12 are formed so as to approach more closely toward the center and the through holes 14 of the radius r4 larger than the radius r3 separated by a given distance and arranged in two columns in two regions g7 located adjacent to the regions g5 where the through holes 13 are formed so as to approach more closely toward the center. These metallic flat plates each further have through holes 15 of a radius r5 larger than the radius r4 separated by a given distance and arranged in four columns in a central region g8 between the regions g7 where the through holes 14 are formed. The through holes 11, the through holes 12, the through holes 13, the through holes 14, and the through holes 15 are all separated by the distance s.

Figures 5, 6:
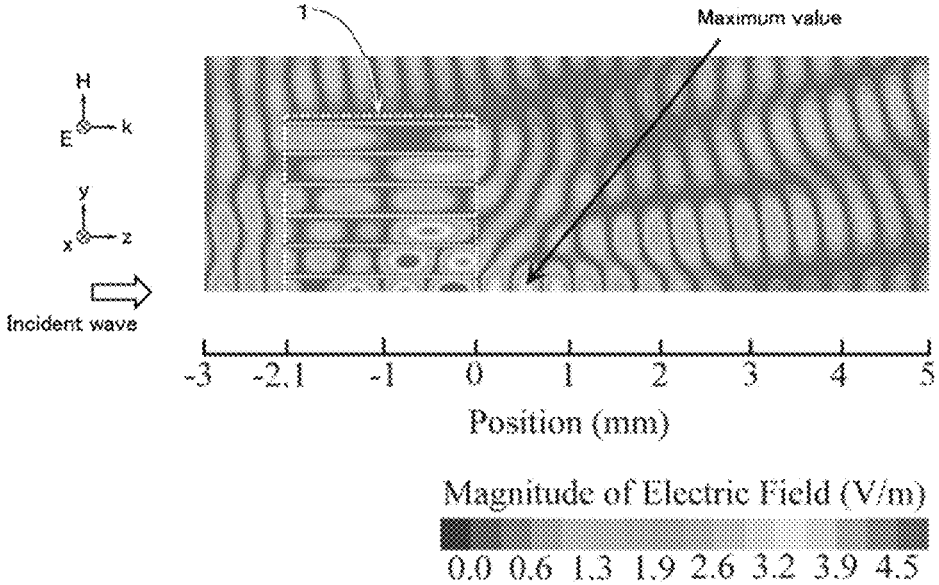
FIG. 5 is a table showing an example of the dimension of a parameter and an example of the dimension of each through hole regarding a metal plate lens including 12 metal plates of this invention following a reference model.
FIG. 6 shows a result of analysis on the metal plate lens of this invention following the reference model.

FIG. 5(*a*) shows the dimensions of parameters of the metal plate lens 1 of this invention following a reference model. FIG. 5(*b*) shows the respective dimensions of the radii r1 to r5 of the through holes 11 to 15 formed in the flat plates 10*a*, 10*b*, 11*a*, 11*b*, 12*a*, 12*b*, 13*a*, 13*b*, 14*a*, 14*b*, 15*a*, and 15*b* following a reference model. FIGS. 5(*a*) and 5(*b*) are prepared on condition that a design frequency f is 0.5 THz and the wavelength λ of the design frequency f in free space is 600 μm.

Regarding the metal plate lens 1 of this invention following the reference model, each of the flat plates 10*a*, 10*b*, 11*a*, 11*b*, 12*a*, 12*b*, 13*a*, 13*b*, 14*a*, 14*b*, 15*a*, and 15*b* has the length 1 of about 2.1 mm (about 3.5λ) in the direction of the optical axis (z-axis) and each of the flat plates 10*a*, 10*b*, 11*a*, 11*b*, 12*a*, 12*b*, 13*a*, 13*b*, 14*a*, 14*b*, 15*a*, and 15*b* has the width w of about 4.2 mm (about 7.0λ) in the x-axis direction. As shown in FIG. 5(*a*), the height h of the metal plate lens 1 in the y-axis direction is about 3.77 mm (about 6.34 the distances d1 to d6 between corresponding ones of the flat plates 10*a*, 10*b*, 11*a*, 11*b*, 12*a*, 12*b*, 13*a*, 13*b*, 14*a*, 14*b*, 15*a*, and 15*b* are uniformly d of about 0.310 mm (about 0.52λ). All the flat plates 10*a*, 10*b*, 11*a*, 11*b*, 12*a*, 12*b*, 13*a*, 13*b*, 14*a*, 14*b*, 15*a*, and 15*b* have the thickness t of about 30 μm (about 0.05λ). Referring now to FIG. 5(*b*), the radius r1 of the through holes 11 formed in each of the flat plates 11*a*, 11*b*, 12*a*, 12*b*, 13*a*, 13*b*, 14*a*, 14*b*, 15*a*, and 15*b* is about 5.0 μm (about 0.0083λ). The radius r2 of the through holes 12 formed in each of the flat plates 12*a*, 12*b*, 13*a*, 13*b*, 14*a*, 14*b*, 15*a*, and 15*b* is about 40 μm (about 0.067λ). The radius r3 of the through holes 13 formed in each of the flat plates 13*a*, 13*b*, 14*a*, 14*b*, 15*a*, and 15*b* is about 65 μm (about 0.11λ). The radius r4 of the through holes 14 formed in each of the flat plates 14*a*, 14*b*, 15*a*, and 15*b* is about 80 μm (about 0.13λ). The radius r5 of the through holes 15 formed in each of the central flat plates 15*a* and 15*b* is about 85 μm (about 0.14λ). Further, the distance s in the x direction and the z direction between the through holes 11, between the through holes 12, between the through holes 13, between the through holes 14, and between the through holes 15 is about 0.175 mm (about 0.29λ).

Figure 7:
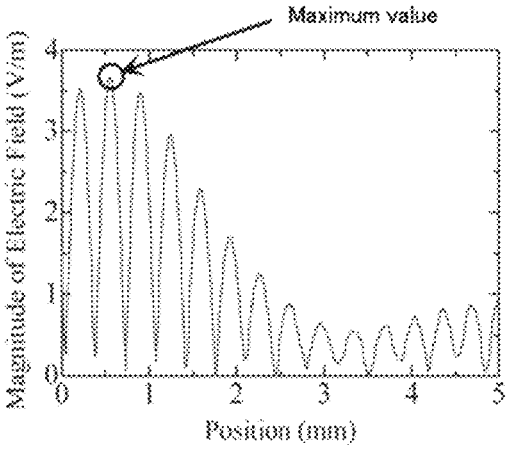
FIG. 7 shows a distribution of the magnitude of an electric field in (V/m) on the optical axis of the metal plate lens of this invention following the reference model.

FIG. 6 shows a result of analysis on the metal plate lens 1 of this invention having the dimensions shown in FIGS. 5(*a*) and 5(*b*). FIG. 7 shows a distribution of the magnitude of an electric field in (V/m) on the optical axis of this metal plate lens 1.

As shown in these drawings, an incident wave to enter the metal plate lens 1 of this invention is an incident wave of the TE mode to progress as a k-field and propagate in the z-axis direction having an electric field component E in the x-axis direction and a magnetic field component H in the y-axis direction, where k is the advancing direction of an electromagnetic wave. This incident wave has a frequency of 0.5 THz. In this case, an adjacent two of the flat plates 10*a*, 10*b*, 11*a*, 11*b*, 12*a*, 12*b*, 13*a*, 13*b*, 14*a*, 14*b*, 15*a*, and 15*b* form a waveguide. The distance d between adjacent flat plates is about 0.310 mm (about 0.52λ). Thus, the cutoff frequency of the waveguide becomes about 0.48 THz, which is lower than 0.5 THz, allowing the incident wave of 0.5 THz to travel through the waveguide. Referring to FIGS. 6 and 7, in the metal plate lens 1 of the reference model, the magnitude of an electric field in (V/m) takes its maximum value in a position separated by about 0.55 mm (about 0.92λ) from the rear end of the metal plate lens 1 and the magnitude of an electric field in (V/m) at the light-collecting position becomes about 3.7 times that of the incident wave.

The foregoing shows that in the metal plate lens 1 of the reference model, the position separated by about 0.55 mm (about 0.92λ) from the rear end of the metal plate lens 1 on the central optical axis (z-axis) becomes a focal point where light is collected three-dimensionally.

Figure 8:
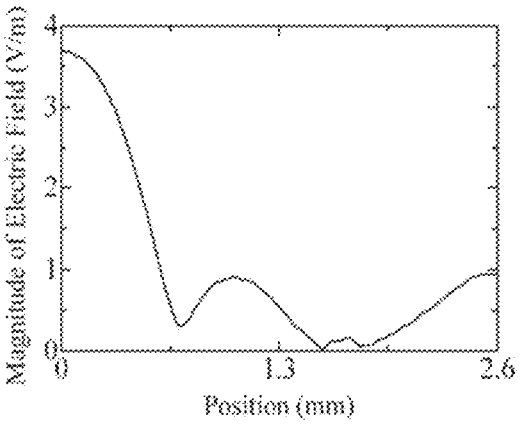
FIG. 8 shows a distribution of the magnitude of an electric field in (V/m) at a focal point in an x direction and a distribution of the magnitude of an electric field in (V/m) at the focal point in a y direction of the metal plate lens of this invention following the reference model.
Figure 8:
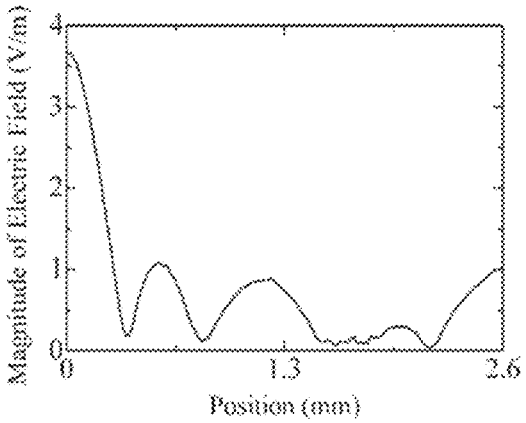

FIG. 8(*a*) shows a distribution of the magnitude of an electric field in (V/m) at this focal point in the x direction. FIG. 8(*b*) shows a distribution of the magnitude of an electric field in (V/m) at this focal point in the y direction. By referring to these drawings, it can be understood that the incident wave is collected three-dimensionally in the aforementioned focal point. It is thus seen that the metal plate lens 1 of the reference model acts as a lens.

Figure 21:
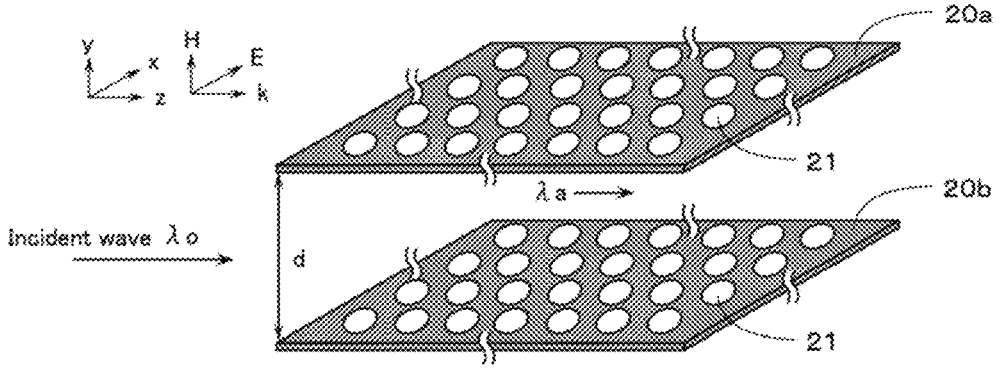
FIG. 21 explains principle of the metal plate lens of the embodiment of this invention.
Figure 21:
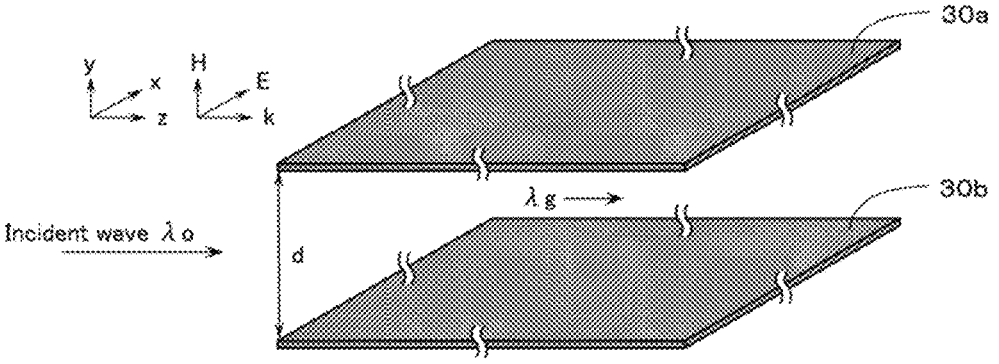

The following describes principle of focusing of the incident wave in the metal plate lens 1 of this invention by referring to FIG. 21. FIG. 21(*a*) shows a structure where two metallic rectangular flat plates 20*a* and 20*b* each provided with through holes 21 of a given radius are arranged to face each other at a distance d. FIG. 21(*b*) shows a structure where two metallic rectangular flat plates 30*a* and 30*b* each provided with no through holes are arranged to face each other at a distance d.

If the two rectangular flat plates 30*a* and 30*b* shown in FIG. 21(*b*) form a waveguide and an incident wave of a wavelength λo to propagate in the z-axis direction having an electric field component E in the x-axis direction and a magnetic field component H in the y-axis direction enters this waveguide, the incident wave is to travel through the waveguide formed of the flat plates 30*a* and 30*b* with a wavelength λg. In this case, λo>λg is established to increase the wavelength in the waveguide. If the two rectangular flat plates 20*a* and 20*b* shown in FIG. 21(*a*) each having a matrix of the through holes 21 of the given radius form a waveguide and an incident wave of the wavelength λo to propagate in the z-axis direction having an electric field component E in the x-axis direction and a magnetic field component H in the y-axis direction enters this waveguide, the incident wave is to travel through the waveguide formed of the flat plates 20*a* and 20*b* with a wavelength λa. In this case, as a result of the provision of the through holes 21, λo<λa is established to increase a wavelength in the waveguide. Meanwhile, the provision of the through holes 21 reduces the fraction of the increase in the wavelength. This establishes λa<λg, resulting in λo<λa<λg.

In the metal plate lens 1 of this invention, the two central flat plates 15*a* and 15*b* are each provided with the through holes 15 of the largest radius r5 formed in its central part, the through holes 14 of the second-largest radius r4 formed on opposite lateral sides of the through holes 15, the through holes 13 of the third-largest radius r3 formed on opposite lateral sides of the through holes 14, the through holes 12 of the fourth-largest radius r2 formed on opposite lateral sides of the through holes 13, and the through holes 11 of the smallest radius r1 formed on opposite lateral sides of the through holes 12. The fourth intermediate flat plates 14*a* and 14*b* adjacent to the central flat plates 15*a* and 15*b* respectively vertically are each provided with the through holes 14 of the second-largest radius r4 formed in its central part, the through holes 13 of the third-largest radius r3 formed on opposite lateral sides of the through holes 14, the through holes 12 of the fourth-largest radius r2 formed on opposite lateral sides of the through holes 13, and the through holes 11 of the smallest radius r1 formed on opposite lateral sides of the through holes 12. The third intermediate flat plates 13*a* and 13*b* adjacent to the fourth intermediate flat plates 14*a* and 14*b* respectively vertically are each provided with the through holes 13 of the third-largest radius r3 formed in its central part, the through holes 12 of the fourth-largest radius r2 formed on opposite lateral sides of the through holes 13, and the through holes 11 of the smallest radius r1 formed on opposite lateral sides of the through holes 12. The second intermediate flat plates 12*a* and 12*b* adjacent to the third intermediate flat plates 13*a* and 13*b* respectively vertically are each provided with the through holes 12 of the fourth-largest radius r2 formed in its central part of a large area, and the through holes 11 of the smallest radius r1 formed on opposite lateral sides of the through holes 12. The first intermediate flat plates 11*a* and 11*b* adjacent to the second intermediate flat plates 12*a* and 12*b* respectively vertically are each provided with the through holes 11 of the smallest radius r1 formed entirely. The top flat plate 10*a* and the bottom flat plate 10*b* adjacent to the first intermediate flat plates 11*a* and 11*b* respectively vertically are not provided with through holes.

Adjacent ones of the flat plates form a waveguide. Further, in the metal plate lens 1 of this invention, through holes of a large radius are formed in the central part of each of the central flat plates 15*a* and 15*b*. Thus, an incident wave travels through the central part with a wavelength approximate to a free space wavelength. The radius of a through hole formed in a flat plate becomes smaller gradually in a position separated further vertically and horizontally from the central part. Thus, the wavelength of the traveling incident wave becomes much longer gradually than the free space wavelength in a position separated further vertically and horizontally from the central part. As a result, the incident wave is focused to make the metal plate lens 1 of this invention act as a lens.

Figures 9, 10:
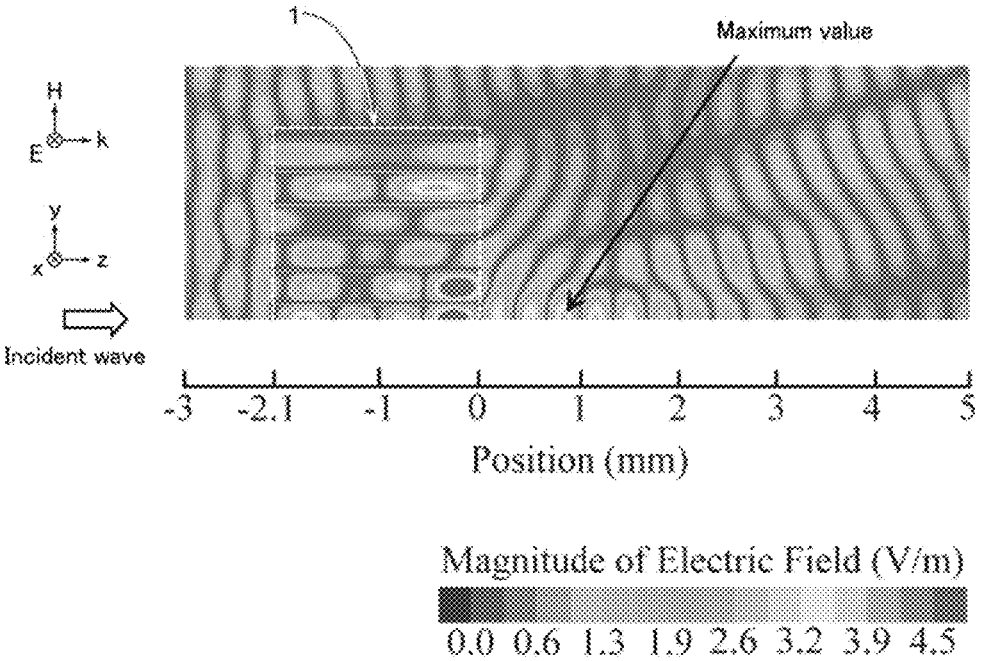
FIG. 9 is a table showing an example of the dimension of a parameter and an example of the dimension of each through hole regarding a metal plate lens including 12 metal plates of this invention following a first model.
FIG. 10 shows a result of analysis on the metal plate lens of this invention following the first model.

A metal plate lens 1 described next follows a first model where the dimensions of the radii r1 to r3 of the through holes 11 to 13 respectively are changed from those of the metal plate lens 1 of the reference model. FIG. 9(*a*) shows the dimensions of parameters of the metal plate lens 1 of this invention following the first model. FIG. 9(*b*) shows the respective dimensions of the radii r1 to r5 of the through holes 11 to 15 formed in the flat plates 10*a*, 10*b*, 11*a*, 11*b*, 12*a*, 12*b*, 13*a*, 13*b*, 14*a*, 14*b*, 15*a*, and 15*b*. FIGS. 9(*a*) and 9(*b*) are prepared on condition that the design frequency f is 0.5 THz and the wavelength λ of the design frequency f in free space is 600 μm.

Regarding the metal plate lens 1 of this invention following the first model, each of the flat plates 10*a*, 10*b*, 11*a*, 11*b*, 12*a*, 12*b*, 13*a*, 13*b*, 14*a*, 14*b*, 15*a*, and 15*b* has the length 1 of about 2.1 mm (about 3.5λ) in the direction of the optical axis (z-axis) and each of the flat plates 10*a*, 10*b*, 11*a*, 11*b*, 12*a*, 12*b*, 13*a*, 13*b*, 14*a*, 14*b*, 15*a*, and 15*b* has the width w of about 4.2 mm (about 7.0λ) in the x-axis direction. As shown in FIG. 9(*a*), the height h of the metal plate lens 1 in the y-axis direction is about 3.77 mm (about 6.3λ), the distances d1 to d6 between corresponding ones of the flat plates 10*a*, 10*b*, 11*a*, 11*b*, 12*a*, 12*b*, 13*a*, 13*b*, 14*a*, 14*b*, 15*a*, and 15*b* are uniformly d of about 0.310 mm (about 0.52λ). All the flat plates 10*a*, 10*b*, 11*a*, 11*b*, 12*a*, 12*b*, 13*a*, 13*b*, 14*a*, 14*b*, 15*a*, and 15*b* have the thickness t of about 30 μm (about 0.05λ). The radius r1 of the through holes 11 formed in each of the flat plates 11*a*, 11*b*, 12*a*, 12*b*, 13*a*, 13*b*, 14*a*, 14*b*, 15*a*, and 15*b* is about 15 μm (about 0.025λ). The radius r2 of the through holes 12 formed in each of the flat plates 12*a*, 12*b*, 13*a*, 13*b*, 14*a*, 14*b*, 15*a*, and 15*b* is about 50 μm (about 0.083λ). The radius r3 of the through holes 13 formed in each of the flat plates 13*a*, 13*b*, 14*a*, 14*b*, 15*a*, and 15*b* is about 70 μm (about 0.12λ). The radius r4 of the through holes 14 formed in each of the flat plates 14*a*, 14*b*, 15*a*, and 15*b* is about 80 μm (about 0.13λ). The radius r5 of the through holes 15 formed in each of the central flat plates 15*a* and 15*b* is about 85 μm (about 0.14λ). Further, the distance s in the x direction and the z direction between the through holes 11, between the through holes 12, between the through holes 13, between the through holes 14, and between the through holes 15 is about 0.175 mm (about 0.29λ).

Figure 11:
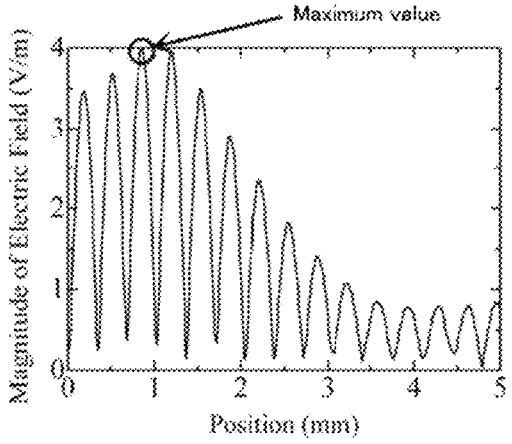
FIG. 11 shows a distribution of the magnitude of an electric field in (V/m) on the optical axis of the metal plate lens of this invention following the first model, and a distribution of the magnitude of an electric field in (V/m) at a focal point in the x direction and a distribution of the magnitude of an electric field in (V/m) at the focal point in the y direction following the first model.
Figure 11:
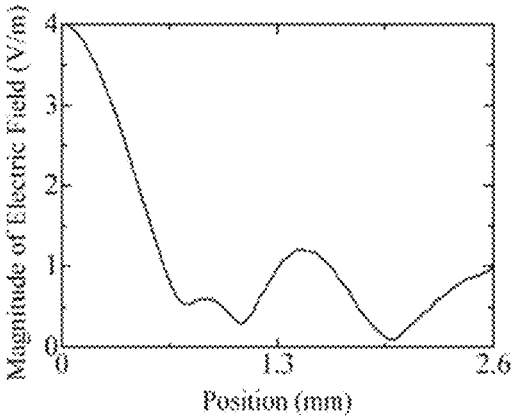
Figure 11:
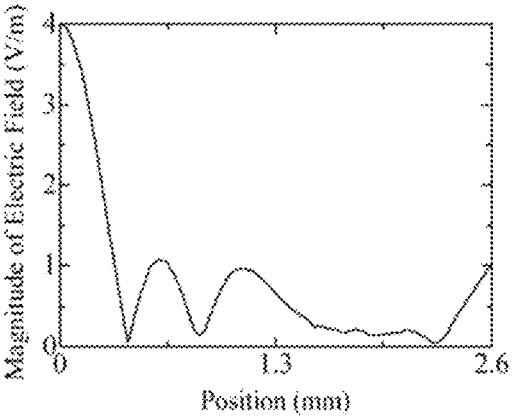

FIG. 10 shows a result of analysis on the metal plate lens 1 of this invention following the first model having the dimensions shown in FIGS. 9(*a*) and 9(*b*). FIG. 11(*a*) shows a distribution of the magnitude of an electric field in (V/m) on the optical axis of this metal plate lens 1.

As shown in these drawings, an incident wave to enter the metal plate lens 1 of this invention following the first model is an incident wave of the TE mode to progress as a k-field and propagate in the z-axis direction having an electric field component E in the x-axis direction and a magnetic field component H in the y-axis direction, where k is the advancing direction of an electromagnetic wave. This incident wave has a frequency of 0.5 THz. In this case, an adjacent two of the flat plates 10*a*, 10*b*, 11*a*, 11*b*, 12*a*, 12*b*, 13*a*, 13*b*, 14*a*, 14*b*, 15*a*, and 15*b* form a waveguide. The distance d between adjacent flat plates is about 0.350 mm (about 0.58λ). Thus, the cutoff frequency of the waveguide becomes about 0.48 THz lower than 0.5 THz, allowing the incident wave of 0.5 THz to travel through the waveguide. Referring to FIGS. 10 and 11(*a*), in the metal plate lens 1 of the first model, the magnitude of an electric field in (V/m) takes its maximum value in a position separated by about 0.86 mm (about 1.4λ) from the rear end of the metal plate lens 1 and the magnitude of an electric field (V/m) at the light-collecting position becomes about four times that of the incident wave.

The foregoing shows that in the metal plate lens 1 of the first model, by changing the radii r1 to r3 of the through holes 11 to 13 respectively in the manner shown in FIG. 9(*b*), the position corresponding to about 0.86 mm (about 1.4λ) separated further by about 0.31 mm from the rear end of the metal plate lens 1 on the central optical axis (z-axis) becomes a focal point where light is collected three-dimensionally, thereby increasing the magnitude of an electric field in (V/m) by four times compared to the incident wave.

FIG. 11(*b*) shows a distribution of the magnitude of an electric field in (V/m) at this focal point in the x direction. FIG. 11(*c*) shows a distribution of the magnitude of an electric field in (V/m) at this focal point in the y direction. By referring to these drawings, it can be understood that the incident wave is collected three-dimensionally in the aforementioned focal point. It is thus seen that the metal plate lens 1 following the first model acts as a lens.

Figures 12, 13:
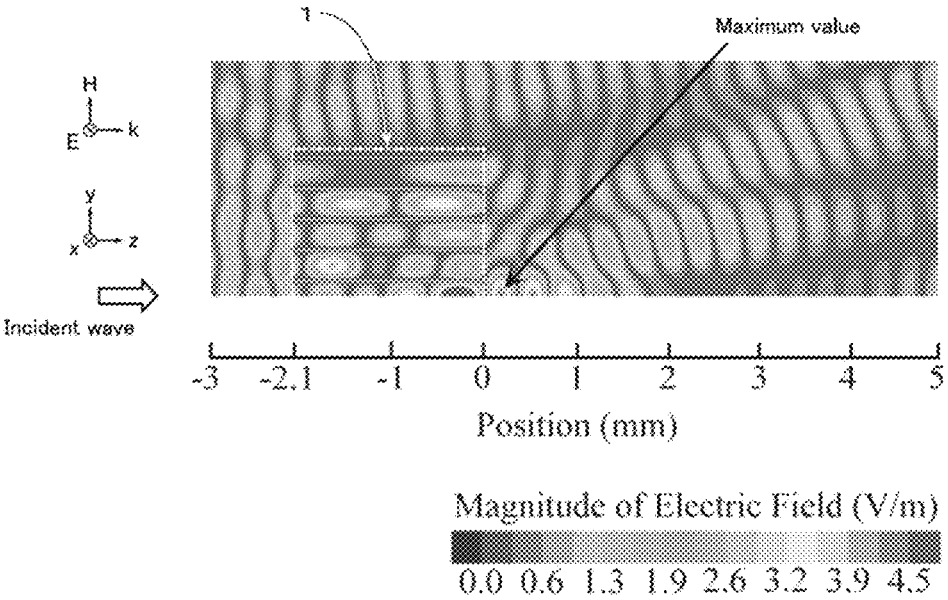
FIG. 12 is a table showing an example of the dimension of a parameter and an example of the dimension of each through hole regarding a metal plate lens of this invention following a second model.
FIG. 13 shows a result of analysis on the metal plate lens of this invention following the second model.

A metal plate lens 1 described next follows a second model where the central flat plates 15*a* and 15*b* are omitted from the metal plate lens 1 of the reference model so the metal plate lens 1 is formed of ten (10) flat plates including the first intermediate flat plates 11*a* and 11*b* to the fourth intermediate flat plates 14*a* and 14*b*, the top flat plate 10*a*, and the bottom flat plate 10*b*, and the respective dimensions of the radii r1 to r4 of the through holes 11 to 14 are changed from those of the metal plate lens 1 of the reference model. FIG. 12(*a*) shows the dimensions of parameters of the metal plate lens 1 of this invention following the second model. FIG. 12(*b*) shows the respective dimensions of the radii r1 to r4 of the through holes 11 to 14 formed in the flat plates 10*a*, 10*b*, 11*a*, 11*b*, 12*a*, 12*b*, 13*a*, 13*b*, 14*a*, and 14*b*. FIGS. 12(*a*) and 12(*b*) are prepared on condition that the design frequency f is 0.5 THz and the wavelength λ of the design frequency fin free space is 600 μm.

Regarding the metal plate lens 1 of this invention following the second model, each of the flat plates 10*a*, 10*b*, 11*a*, 11*b*, 12*a*, 12*b*, 13*a*, 13*b*, 14*a*, and 14*b* has the length 1 of about 2.1 mm (about 3.5λ) in the direction of the optical axis (z-axis) and each of the flat plates 10*a*, 10*b*, 11*a*, 11*b*, 12*a*, 12*b*, 13*a*, 13*b*, 14*a*, and 14*b* has the width w of about 4.2 mm (about 7.0λ) in the x-axis direction. As shown in FIG. 12(*a*), the height h of the metal plate lens 1 in the y-axis direction is about 3.09 mm (about 5.15λ), the distances d2 to d6 between corresponding ones of the flat plates 10*a*, 10*b*, 11*a*, 11*b*, 12*a*, 12*b*, 13*a*, 13*b*, 14*a*, and 14*b* are uniformly d of about 0.310 mm (about 0.52λ). All the flat plates 10*a*, 10*b*, 11*a*, 11*b*, 12*a*, 12*b*, 13*a*, 13*b*, 14*a*, and 14*b* have the thickness t of about 30 μm (about 0.05λ). The radius r1 of the through holes 11 formed in each of the flat plates 11*a*, 11*b*, 12*a*, 12*b*, 13*a*, 13*b*, 14*a*, and 14*b* is about 25 μm (about 0.042λ). The radius r2 of the through holes 12 formed in each of the flat plates 12*a*, 12*b*, 13*a*, 13*b*, 14*a*, and 14*b* is about 55 μm (about 0.092λ). The radius r3 of the through holes 13 formed in each of the flat plates 13*a*, 13*b*, 14*a*, and 14*b* is about 75 μm (about 0.13λ). The radius r4 of the through holes 14 formed in each of the fourth intermediate flat plates 14*a* and 14*b* is about 85 μm (about 0.14λ). Further, the distance s in the x direction and the z direction between the through holes 11, between the through holes 12, between the through holes 13, and between the through holes 14 is about 0.175 mm (about 0.29λ).

Figure 14:
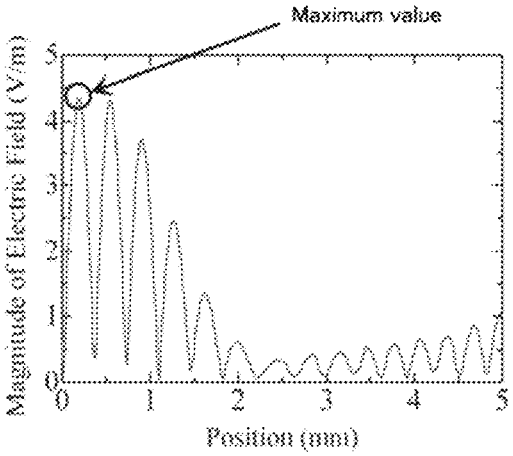
FIG. 14 shows a distribution of the magnitude of an electric field in (V/m) on the optical axis of the metal plate lens of this invention following the second model, and a distribution of the magnitude of an electric field in (V/m) at a focal point in the x direction and a distribution of the magnitude of an electric field in (V/m) at the focal point in the y direction following the second model.
Figure 14:
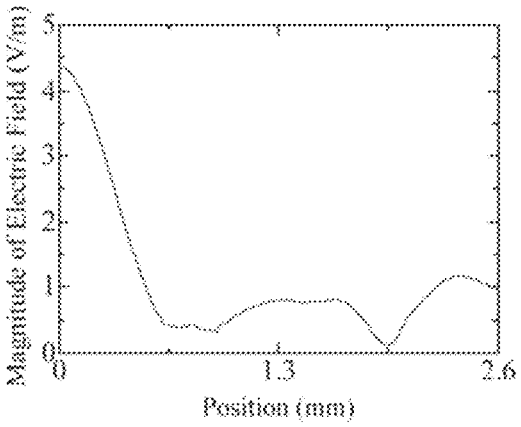
Figure 14:
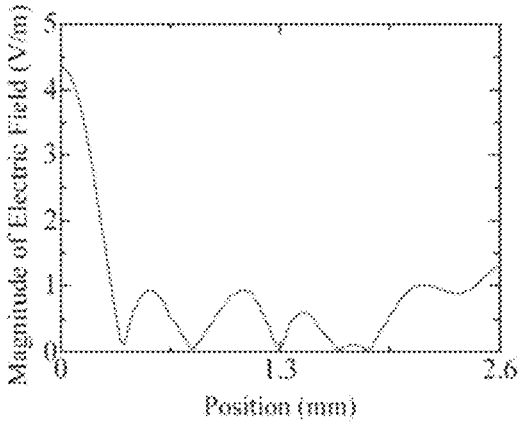

FIG. 13 shows a result of analysis on the metal plate lens 1 of this invention following the second model having the dimensions shown in FIGS. 12(*a*) and 12(*b*). FIG. 14(*a*) shows a distribution of the magnitude of an electric field in (V/m) on the optical axis of this metal plate lens 1.

As shown in FIG. 13, an incident wave to enter the metal plate lens 1 of this invention following the second model is an incident wave of the TE mode to progress as a k-field and propagate in the z-axis direction having an electric field component E in the x-axis direction and a magnetic field component H in the y-axis direction, where k is the advancing direction of an electromagnetic wave. This incident wave has a frequency of 0.5 THz. In this case, an adjacent two of the flat plates 10*a*, 10*b*, 11*a*, 11*b*, 12*a*, 12*b*, 13*a*, 13*b*, 14*a*, and 14*b* form a waveguide. The distance d between adjacent flat plates is about 0.310 mm (about 0.52λ). Thus, the cutoff frequency of the waveguide becomes about 0.48 THz lower than 0.5 THz, allowing the incident wave of 0.5 THz to travel through the waveguide. Referring to FIGS. 13 and 14(*a*), in the metal plate lens 1 of the second model, the magnitude of an electric field in (V/m) takes its maximum value in a position in mm that separated by about 0.19 mm (about 0.32λ) from the rear end of the metal plate lens 1 and the magnitude of an electric field in (V/m) at the light-collecting position becomes about 4.4 times that of the incident wave.

The foregoing shows that in the metal plate lens 1 of the second model, by omitting the central flat plates 15*a* and 15*b* and preparing ten (10) flat plates and by changing the respective dimensions of the radii r1 to r4 of the through holes 11 to 14, the position corresponding to about 0.19 mm (about 0.32λ) closer by about 0.36 mm (about 0.60λ) to the rear end of the metal plate lens 1 on the central optical axis (z-axis) becomes a focal point where light is collected three-dimensionally, thereby increasing the magnitude of an electric field in (V/m) by 4.4 times compared to the incident wave.

FIG. 14(*b*) shows a distribution of the magnitude of an electric field in (V/m) at this focal point in the x direction. FIG. 14(*c*) shows a distribution of the magnitude of an electric field in (V/m) at this focal point in the y direction. By referring to these drawings, it can be understood that the incident wave is collected three-dimensionally in the aforementioned focal point. It is thus seen that the metal plate lens 1 of the second model acts as a lens.

The foregoing shows that the aforementioned metal plate lens 1 of this invention following any of the reference model, the first model, and the second model achieves three-dimensional light collection. This allows the metal plate lens 1 to act as a lens to achieve light-collecting effect using the structure shown in FIG. 1. Further, comparison among the distributions of the magnitude of an electric field in (V/m) on the corresponding optical axes shown in FIGS. 7, 11(*a*), and 14(*a*) shows that in the first model, a focal length longer than that in the reference model makes a refractive index approach 1. Regarding the second model, light is focused on the position of about 0.19 mm (about 0.32λ). In this case, a refractive index is considered to be approximate to 0. These results show that in the metal plate lens 1 of this invention, the refractive index of the metal plate lens 1 can be controlled by changing the respective radii r1 to r5 of the through holes 11 to 15 formed in the flat plates 11*a* to 15*b*.

A metal plate lens 1 described next follows a third model where the dimension of the distance d between corresponding ones of the flat plates 10*a*, 10*b*, 11*a*, 11*b*, 12*a*, 12*b*, 13*a*, 13*b*, 14*a*, 14*b*, 15*a*, and 15*b* is changed from that of the metal plate lens 1 of the reference model. FIG. 15 shows the dimensions of parameters of the metal plate lens 1 of this invention following the third model. FIG. 15 is prepared on condition that the design frequency f is 0.5 THz and the wavelength λ of the design frequency f in free space is 600 μm. The respective dimensions of the radii r1 to r5 of the through holes 11 to 15 formed in the flat plates 10*a*, 10*b*, 11*a*, 11*b*, 12*a*, 12*b*, 13*a*, 13*b*, 14*a*, and 14*b* are the same as those of the metal plate lens 1 of the reference model.

Regarding the metal plate lens 1 of this invention following the third model, each of the flat plates 10*a*, 10*b*, 11*a*, 11*b*, 12*a*, 12*b*, 13*a*, 13*b*, 14*a*, and 14*b* has the length 1 of about 2.1 mm (about 3.5λ) in the direction of the optical axis (z-axis) and each of the flat plates 10*a*, 10*b*, 11*a*, 11*b*, 12*a*, 12*b*, 13*a*, 13*b*, 14*a*, and 14*b* has the width w of about 4.2 mm (about 7.0λ) in the x-axis direction. As shown in FIG. 15, the height h of the metal plate lens 1 in the y-axis direction is about 4.21 mm (about 7.02λ), the distances d1 to d6 between corresponding ones of the flat plates 10*a*, 10*b*, 11*a*, 11*b*, 12*a*, 12*b*, 13*a*, 13*b*, 14*a*, and 14*b* are uniformly d of about 0.350 mm (about 0.58λ). All the flat plates 10*a*, 10*b*, 11*a*, 11*b*, 12*a*, 12*b*, 13*a*, 13*b*, 14*a*, and 14*b* have the thickness t of about 30 μm (about 0.05λ). Further, the distance s in the x direction and the z direction between the through holes 11, between the through holes 12, between the through holes 13, between the through holes 14, and between the through holes 15 is about 0.175 mm (about 0.29λ).

FIG. 16 shows a result of analysis on the metal plate lens 1 of this invention following the third model having the dimensions shown in FIG. 15. FIG. 17 shows a distribution of the magnitude of an electric field in (V/m) on the optical axis of this metal plate lens 1.

As shown in these drawings, an incident wave to enter the metal plate lens 1 of this invention following the third model is an incident wave of the TE mode to progress as a k-field and propagate in the z-axis direction having an electric field component E in the x-axis direction and a magnetic field component H in the y-axis direction, where k is the advancing direction of an electromagnetic wave. This incident wave has a frequency of 0.5 THz. In this case, an adjacent two of the flat plates 10*a*, 10*b*, 11*a*, 11*b*, 12*a*, 12*b*, 13*a*, 13*b*, 14*a*, and 14*b* form a waveguide. The distance d between adjacent flat plates is about 0.310 mm (about 0.52λ). Thus, the cutoff frequency of the waveguide becomes about 0.48 THz lower than 0.5 THz, allowing the incident wave of 0.5 THz to travel through the waveguide. Referring to FIGS. 16 and 17, in the metal plate lens 1 of the third model, the magnitude of an electric field in (V/m) takes its maximum value in a position in mm that separated by about 1.54 mm (about 2.6λ) from the rear end of the metal plate lens 1 and the magnitude of an electric field in (V/m) at the light-collecting position becomes about 3.7 times that of the incident wave.

In the metal plate lens 1 of the third model, the light-collecting position is separated further by about 0.99 mm (about 1.7λ) than that in the metal plate lens 1 of the reference model. Meanwhile, the magnitude of an electric field in (V/m) becomes substantially the same as that in the metal plate lens 1 of the reference model. Increasing the dimension of the distance d between corresponding ones of the flat plates 10*a* and 15*b* increases a focal distance. Thus, a refractive index is considered to approach 1. In this way, the refractive index can also be changed by changing the distance d between corresponding ones of the flat plates 10*a*, 10*b*, 11*a*, 11*b*, 12*a*, 12*b*, 13*a*, 13*b*, 14*a*, and 14*b*.

Comparison between the distributions of the magnitude of an electric field in (V/m) on the corresponding optical axes shown in FIGS. 7 and 17 shows that, while the respective magnitudes are substantially the same, a longer focal distance is confirmed in the third model. This is considered to be caused by the following. In the case of a flat plate with no through holes, a larger distance between such flat plates makes a refractive index approach 1 more closely and the metal plate lens 1 of the third model is affected by this feature. In this way, the refractive index of the metal plate lens 1 of this invention can also be controlled by changing the distance d between corresponding ones of the flat plates 10*a*, 10*b*, 11*a*, 11*b*, 12*a*, 12*b*, 13*a*, 13*b*, 14*a*, and 14*b*.

A metal plate lens 1 described next follows a fourth model where the dimensions of the distances d1 to d6 between corresponding ones of the flat plates 10*a* to 15*b* are changed from those of the metal plate lens 1 of the reference model. FIG. 18 shows the dimensions of parameters of the metal plate lens 1 of this invention following the fourth model. FIG. 18 is prepared on condition that the design frequency f is 0.5 THz and the wavelength λ of the design frequency f in free space is 600 μm. The respective dimensions of the radii r1 to r5 of the through holes 11 to 15 formed in the flat plates 10*a*, 10*b*, 11*a*, 11*b*, 12*a*, 12*b*, 13*a*, 13*b*, 14*a*, and 14*b* are the same as those of the metal plate lens 1 of the reference model.

Regarding the metal plate lens 1 of this invention following the fourth model, each of the flat plates 10*a*, 10*b*, 11*a*, 11*b*, 12*a*, 12*b*, 13*a*, 13*b*, 14*a*, and 14*b* has the length 1 of about 2.1 mm (about 3.5λ) in the direction of the optical axis (z-axis) and each of the flat plates 10*a* to 15*b* has the width w of about 4.2 mm (about 7.0λ) in the x-axis direction. As shown in FIG. 18, the height h of the metal plate lens 1 in the y-axis direction is about 4.02 mm (about 6.7λ). The distance d1 between the central flat plates 15*a* and 15*b* is about 0.36 mm (about 0.60λ). The distance d2 between the central flat plate 15*a* and the fourth intermediate flat plate 14*a* and between the central flat plate 15*b* and the fourth intermediate flat plate 14*b* is about 0.35 mm (about 0.58λ). The distance d3 between the fourth and third intermediate flat plates 14*a* and 13*a* and between the fourth and third intermediate flat plates 14*b* and 13*b* is about 0.34 mm (about 0.57λ). The distance d4 between the third and second intermediate flat plates 13*a* and 12*a* and between the third and second intermediate flat plates 13*b* and 12*b* is about 0.33 mm (about 0.55λ). The distance d5 between the second and first intermediate flat plates 12*a* and 11*a* and between the second and first intermediate flat plates 12*b* and 11*b* is about 0.32 mm (about 0.53λ). The distance d6 between the first intermediate flat plate 11*a* and the top flat plate 10*a* and between the first intermediate flat plate 11*b* and the bottom flat plate 10*b* is about 0.31 mm (about 0.52λ). All the flat plates 10*a* to 15*b* have the thickness t of about 30 μm (about 0.05λ). Further, the distance s in the x direction and the z direction between the through holes 11, between the through holes 12, between the through holes 13, between the through holes 14, and between the through holes 15 is about 0.175 mm (about 0.29λ).

FIG. 19 shows a result of analysis on the metal plate lens 1 of this invention following the fourth model having the dimensions shown in FIG. 18. FIG. 20 shows a distribution of the magnitude of an electric field in (V/m) on the optical axis of this metal plate lens 1.

As shown in FIG. 19, an incident wave to enter the metal plate lens 1 of this invention following the fourth model is an incident wave of the TE mode to progress as a k-field and propagate in the z-axis direction having an electric field component E in the x-axis direction and a magnetic field component H in the y-axis direction, where k is the advancing direction of an electromagnetic wave. This incident wave has a frequency of 0.5 THz. In this case, an adjacent two of the flat plates 10*a*, 10*b*, 11*a*, 11*b*, 12*a*, 12*b*, 13*a*, 13*b*, 14*a*, and 14*b* form a waveguide. The distance d between adjacent flat plates is about 0.310 mm (about 0.52λ) or more. Thus, the cutoff frequency of the waveguide becomes about 0.48 THz lower than 0.5 THz, allowing the incident wave of 0.5 THz to travel through the waveguide. Referring to FIGS. 19 and 20, in the metal plate lens 1 of the fourth model, the magnitude of an electric field in (V/m) takes its maximum value in a position in mm that separated by about 1.02 mm (about 1.7λ) from the rear end of the metal plate lens 1 and the magnitude of an electric field in (V/m) at the light-collecting position becomes about 6.2 times that of the incident wave.

In the metal plate lens 1 of this invention following the fourth model, a distance between the central flat plates is increased while a distance between flat plates becomes smaller in a position separated further vertically from the central flat plates. By differing a distance in each layer between corresponding ones of the flat plates 10*a*, 10*b*, 11*a*, 11*b*, 12*a*, 12*b*, 13*a*, 13*b*, 14*a*, and 14*b*, a large phase difference is produced between an electromagnetic wave to pass through the central part and an electromagnetic wave to pass through the top or the bottom of the metal plate lens 1. As a result, the magnitude of an electric field in (V/m) at a focal point can be higher than that in the reference model.

Like a concave lens, the metal plate lenses 1 shown in FIGS. 6, 10, 13, 16, and 19 were analyzed with High Frequency Electromagnetic Field Simulation Software (HFSS™) available from ANSYS®, Inc. Like a concave lens, these metal plate lenses 1 were analyzed through a method employing a quarter model involving a small volume for analysis by utilizing principle of imaging.

INDUSTRIAL APPLICABILITY

The aforementioned metal plate lens of this invention is applicable to a range of a short wavelength such as that of a terahertz wave without employing a structure to achieve a negative refractive index. However, the metal plate lens of this invention is applicable not only to a terahertz wave but also to a lens of a different frequency band. For such application, the physical dimension of each part may be changed according to the center wavelength of a frequency band to be applied so as to conform to the dimension of the aforementioned electric length expressed in terms of λ (wavelength). According to a realistic way to form the aforementioned metal plate lens of this invention, each distance between flat plates is kept at a given distance by interposing a dielectric substance of a low relative permittivity as close to 1 as possible having a thickness corresponding to the required distance between the flat plates or by forming a metallic layer on a surface of the dielectric substance and supporting each flat plate with a support substrate made of the dielectric substance. In this case, a wavelength is reduced in a way that depends on the relative permittivity of the dielectric substance. Thus, in consideration of the rate of the reduction in the wavelength, the physical dimension of each part may be changed appropriately so as to conform to the dimension of the aforementioned electric length expressed in terms of λ (wavelength).

In the description given above, the radius of a through hole formed in a flat plate forming the metal plate lens of this invention becomes smaller gradually in a position separated further vertically and horizontally from the central part. Alternatively, the radius of the through hole may become smaller gradually in a position separated further vertically from the central part whereas the radius of the through hole may be constant in a direction from the central part to the right and left. Further, the shape of the through hole is not limited to a circle. Alternatively, the through hole may be a triangular, rectangular, polygonal, or oval shape that is the largest in the central part and becomes smaller in a position separated further from the central part. The through hole to have a triangular, rectangular, or polygonal shape is formed by processing with a drill, for example. This produces a rounded corner of the through hole.

The aforementioned dimensions of the metal plate lens of this invention following the reference model and the first to fourth models are given not as exclusive dimensions but are given by way of example only. The shape of the metal plate lens of this invention as viewed from the front is not limited to the aforementioned rectangle but it may alternatively be a circle or a polygon.

A split ring resonator may be attached to an input side of the metal plate lens 1 for impedance matching. The split ring resonator is formed of a first split ring of a circular ring shape having a cut and a second split ring of a circular ring shape smaller in outer diameter than the first split ring. The second split ring is arranged inside the first split ring substantially concentrically in the same plane and has a cut formed on a side opposite the cut of the first split ring. In this split ring resonator, a magnetic permeability can be controlled by adjusting the respective diameters or the respective dimensions of the widths of the first and second split rings, thereby achieving impedance matching.

REFERENCE SIGNS LIST

1 Metal plate lens
10*a* Top flat plate
10*b* Bottom flat plate
11 Through hole
11*a*, 11*b* First intermediate flat plate
12 Through hole
12*a*, 12*b* Second intermediate flat plate
13 Through hole
13*a*, 13*b* Third intermediate flat plate
14 Through hole
14*a*, 14*b* Fourth intermediate flat plate
15 Through hole
15*a*, 15*b* Central flat plate
20*a*, 20*b*, 30*a*, 30*b* Flat plate
21 Through hole

The invention claimed is:

1. A metal plate lens comprising metallic flat plates, the metal plate lens having an optical axis as a central axis defined as a z-axis, and axes perpendicular to the z-axis defined as an x-axis and a y-axis, the metallic flat plates being formed on corresponding multiple planes so as to overlap each other, the multiple planes being parallel to an x-z plane and separated by a given distance along the y-axis, wherein a propagation direction of an incident wave is the z-axis direction, and two or more of the multiple flat plates arranged so as to overlap each other except a top flat plate arranged at the top and a bottom flat plate arranged at the bottom are each provided with multiple through holes of a given size, a central flat plate of the flat plates arranged in a central part is provided with the through holes of a first size, an intermediate flat plate arranged between the central flat plate and the top flat plate and an intermediate flat plate arranged between the central flat plate and the bottom flat plate are each provided with the through holes of a second size smaller than the first size, and when the intermediate flat plate arranged between the central flat plate and the top flat plate includes multiple intermediate flat plates and the intermediate flat plate arranged between the central flat plate and the bottom flat plate includes multiple intermediate flat plates, the second size of the through holes formed in one of the multiple intermediate flat plates arranged in a position farther from the central flat plate is smaller than the second size of the through holes formed in one of the multiple intermediate flat plates arranged in a position closer to the central flat plate.

2. The metal plate lens according to claim 1, wherein in one of the intermediate flat plates closer to the central flat plate, the through holes of the second size are arranged in a matrix in a central region in the center of this intermediate flat plate, multiple lateral regions are formed between the central region and each of opposite lateral portions relative to the central region, and the through holes of a fourth size are formed in multiple columns in each of the multiple lateral regions, the fourth size becoming smaller in a position closer to each of the opposite lateral portions.

3. The metal plate lens according to claim 2, wherein a refractive index is controlled by adjusting the respective dimensions of the through holes.

4. The metal plate lens according to claim 2, wherein a refractive index is controlled by adjusting a distance between corresponding ones of the multiple flat plates arranged so as to overlap each other.

5. The metal plate lens according to claim 1, wherein in the central flat plate, the through holes of the first size are arranged in multiple columns in a central region in the center of the central flat plate, multiple lateral regions are formed between the central region and each of opposite lateral portions relative to the central region, and the through holes of a third size are formed in multiple columns in each of the multiple lateral regions, the third size becoming smaller in a position closer to each of the opposite lateral portions.

6. The metal plate lens according to claim 5, wherein in one of the intermediate flat plates closer to the central flat plate, the through holes of the second size are arranged in a matrix in a central region in the center of this intermediate flat plate, multiple lateral regions are formed between the central region and each of opposite lateral portions relative to the central region, and the through holes of a fourth size are formed in multiple columns in each of the multiple lateral regions, the fourth size becoming smaller in a position closer to each of the opposite lateral portions.

7. The metal plate lens according to claim 6, wherein a refractive index is controlled by adjusting the respective dimensions of the through holes.

8. The metal plate lens according to claim 6, wherein a refractive index is controlled by adjusting a distance between corresponding ones of the multiple flat plates arranged so as to overlap each other.

9. The metal plate lens according to claim 5, wherein a refractive index is controlled by adjusting the respective dimensions of the through holes.

10. The metal plate lens according to claim 5, wherein a refractive index is controlled by adjusting a distance between corresponding ones of the multiple flat plates arranged so as to overlap each other.

11. The metal plate lens according to claim 1, wherein a refractive index is controlled by adjusting the respective dimensions of the through holes.

12. The metal plate lens according to claim 1, wherein a refractive index is controlled by adjusting a distance between corresponding ones of the multiple flat plates arranged so as to overlap each other.

* * * * *